US012529538B2

(12) United States Patent
Smith

(10) Patent No.: US 12,529,538 B2
(45) Date of Patent: Jan. 20, 2026

(54) SAFETY MECHANISM FOR FIREARM

(71) Applicant: Cameron Smith, Wabash, IN (US)

(72) Inventor: Cameron Smith, Wabash, IN (US)

(73) Assignee: ABC IP, LLC, Dover, DE (US)

( * ) Notice: Subject to any disclaimer, the term of this patent is extended or adjusted under 35 U.S.C. 154(b) by 0 days.

(21) Appl. No.: 18/968,984

(22) Filed: Dec. 4, 2024

(65) Prior Publication Data

US 2025/0180315 A1 Jun. 5, 2025

Related U.S. Application Data

(60) Provisional application No. 63/605,793, filed on Dec. 4, 2023.

(51) Int. Cl.
*F41A 17/46* (2006.01)

(52) U.S. Cl.
CPC ..... *F41A 17/46* (2013.01)

(58) Field of Classification Search
CPC ..... F41A 17/46; F41A 19/46; F41A 19/02; F41A 19/10
USPC ..... 42/70.06; 89/142, 132
See application file for complete search history.

(56) References Cited

U.S. PATENT DOCUMENTS

| | | | |
|---|---|---|---|
| 2,056,975 | A | 10/1936 | Michal, Jr. |
| 6,389,728 | B1 | 5/2002 | Lundy |
| 7,398,723 | B1 | 7/2008 | Blakley |
| 9,568,264 | B2 | 2/2017 | Graves |
| 9,816,772 | B2 | 11/2017 | Graves |
| 9,823,032 | B2 | 11/2017 | Allan |
| 9,939,221 | B2 | 4/2018 | Graves |
| 10,466,002 | B1 * | 11/2019 | Geissele ..... F41A 19/02 |
| 10,514,223 | B1 | 12/2019 | Rounds |
| 10,989,488 | B2 | 4/2021 | Acarreta et al. |
| 11,359,878 | B2 | 6/2022 | Moretti |
| 11,724,003 | B2 | 8/2023 | Strbac |
| 12,038,247 | B2 | 7/2024 | Blakley |
| 12,169,105 | B1 | 12/2024 | Barry |
| 2022/0178639 | A1 | 6/2022 | Song et al. |

OTHER PUBLICATIONS

Hoffman Tactical, "Introducing the Super Safety", video link titled "Introducing the Super Safety" posted on Jul. 21, 2023. https://www.youtube.com/watch?v=i1ADTvaYhY4.

* cited by examiner

*Primary Examiner* — Reginald S Tillman, Jr.
(74) *Attorney, Agent, or Firm* — Wood Herron & Evans LLP

(57) ABSTRACT

A safety mechanism for a firearm includes a cam selector, a lever, and a trigger. The cam selector comprises a first end, a second end, a top side, and a bottom side. The cam selector comprises a longitudinal slot positioned on the top side of the cam selector. The lever comprises a proximal end and a distal end. The longitudinal slot is configured to receive the lever. The cam selector further comprises a first recess and a second recess on the bottom side of the cam selector. The trigger comprises a first trigger tail portion. In addition to the standard semi-automatic and safe modes, the present invention provides an additional active reset mode in which the cam selector is configured to allow the first trigger tail portion to engage the second recess and be moved down by a cam portion of the second recess when the cam selector rotates.

13 Claims, 15 Drawing Sheets

SAFETY MECHANISM FOR FIREARM

FIELD OF THE INVENTION

The present invention relates generally to a safety selector mechanism. More specifically, the present invention is a safety selector mechanism suitable for semi-auto firearms and rifles.

BACKGROUND OF THE INVENTION

A firearm safety catch encompasses various safety mechanisms integral to responsible gun design, aimed at preventing accidental discharges and ensuring overall safety. One common type is the manual safety switch, typically located near the trigger or on the firearm's frame, which physically obstructs the firing mechanism when engaged. Trigger safety, integrated directly into the trigger, requires a specific action for the trigger to move, preventing unintentional pulls. A grip safety, found in certain handguns, necessitates depression by the shooter's hand for the firearm to fire. Other safety features include a drop safety or firing pin block to prevent accidental discharges if the firearm is dropped, and a magazine disconnect safety that inhibits firing when the magazine is removed. These safety catches collectively contribute to responsible firearm handling, and users are encouraged to familiarize themselves with these features, adhering to proper procedures to ensure safe gun ownership.

SUMMARY OF THE INVENTION

The present invention discloses a safety mechanism for a firearm. It comprises a cam selector, a lever, and a trigger. The cam selector comprises a first end, a second end, a top side, and a bottom side. The cam selector comprises a longitudinal slot positioned on the top side of the cam selector. The lever comprises a proximal end and a distal end. The longitudinal slot is configured to receive the proximal end of the lever. The cam selector further comprises a first recess and a second recess on the bottom side of the cam selector. The trigger comprises a first trigger tail portion. The cam selector is configured to operate between a first mode, a second mode, and a third mode. The first mode of the cam selector is configured to allow the first trigger tail portion to be movable within the first recess. The second mode of the cam selector is configured to allow the first trigger tail portion to engage the second recess and be moved down by a cam portion of the second recess when the cam selector rotates. The third mode of the cam selector is configured to prevent the trigger from being pulled.

In one embodiment, the cam selector has a substantially cylindrical shape.

In one embodiment, the present invention further comprises a detent. The cam selector further comprises a first detent track, a second detent track and a third detent track. The detent is configured to move between the first detent track, the second detent track and the third detent track to select between the first mode, the second mode, and the third mode of the cam selector.

In one embodiment, the first detent track, the second detent track, and the third detent track are configured to allow the detent to move along the first detent track, the second detent track, and the third detent track, respectively.

In one embodiment, the first detent track, the second detent track, and the third detent track are transverse grooves on the bottom side of the cam selector.

In one embodiment, the first detent track, the second detent track and the third detent track are positioned adjacent to the first end of the cam selector.

In one embodiment, the detent comprises a rounded top end.

In one embodiment, the longitudinal slot extends from the first end of the cam selector.

In one embodiment, the longitudinal slot is ovular shaped and comprises an opening to allow the lever to travel trough.

In one embodiment, the lever comprises a dovetail portion at the proximal end.

In one embodiment, the lever further comprises a bent portion adjacent to the distal end.

In one embodiment, the first trigger tail portion of the trigger is rounded.

In one embodiment, the trigger further comprises a second trigger tail portion that has a corner cutout.

BRIEF DESCRIPTION OF THE DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the present invention. That is, the dimensions of the components of the present invention, independently and in relation to each other can be different. It should be noted that the drawings are schematic and not necessarily drawn to scale. Some drawings are enlarged or reduced to improve drawing legibility.

DETAIL DESCRIPTIONS OF THE INVENTION

Figure 1:
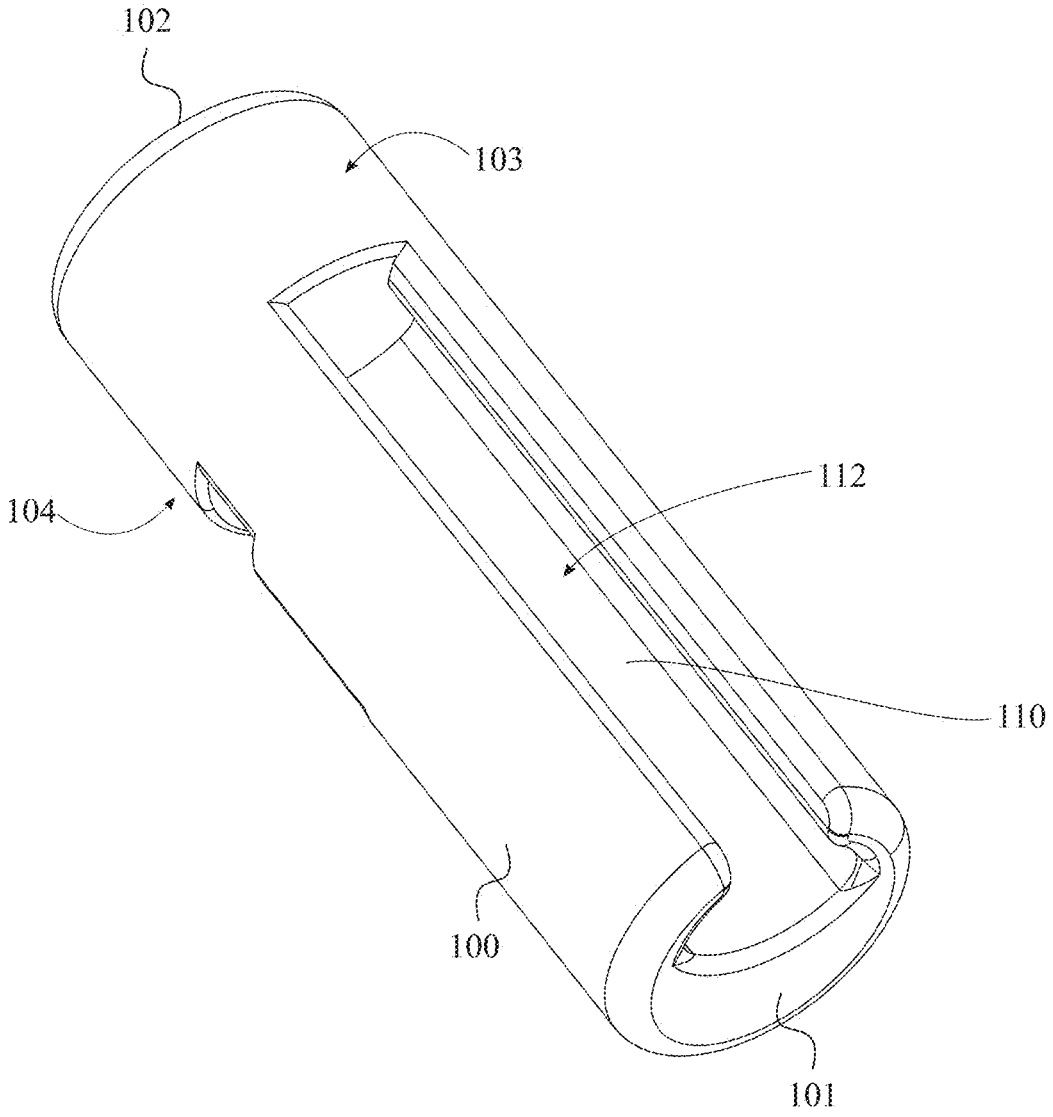
FIG. 1 depicts a top perspective view of a cam selector of the present invention.
Figure 2:
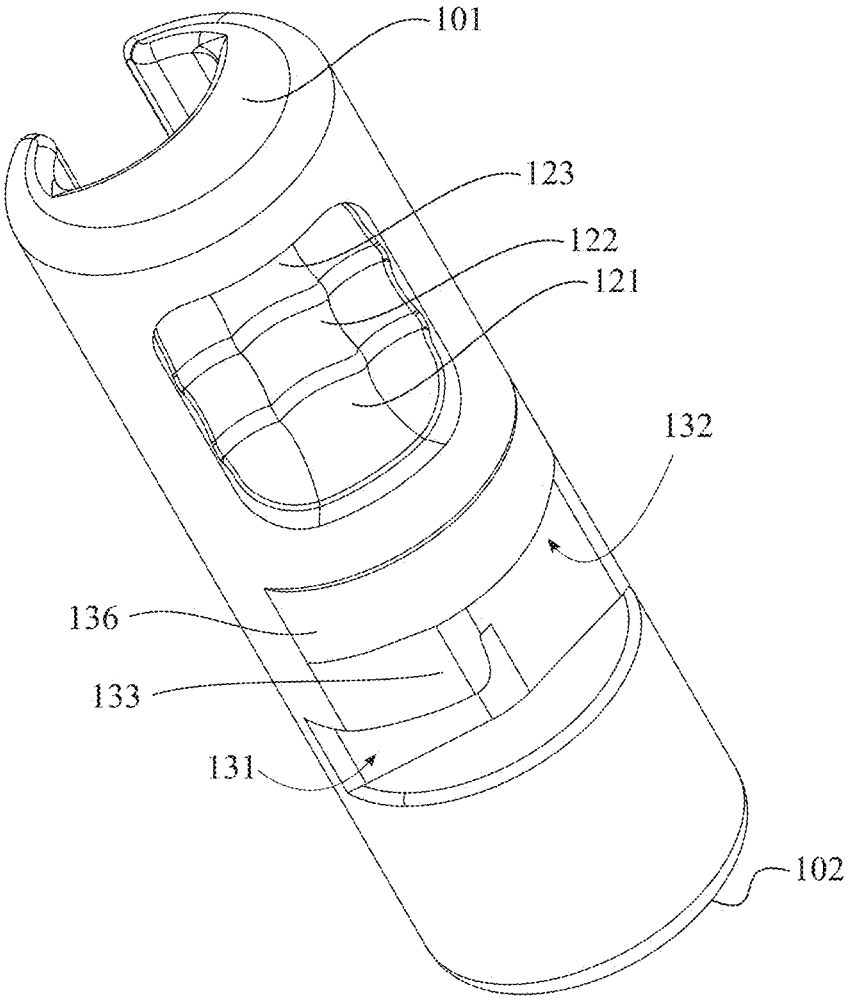
FIG. 2 depicts a bottom perspective view of the cam selector of the present invention.
Figure 3:
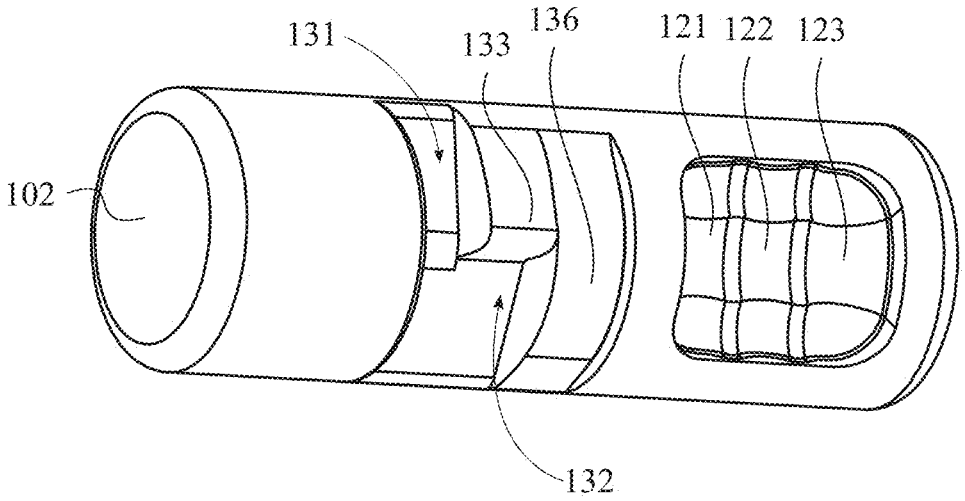
FIG. 3 depicts another bottom perspective view of the cam selector of the present invention.
Figure 4:
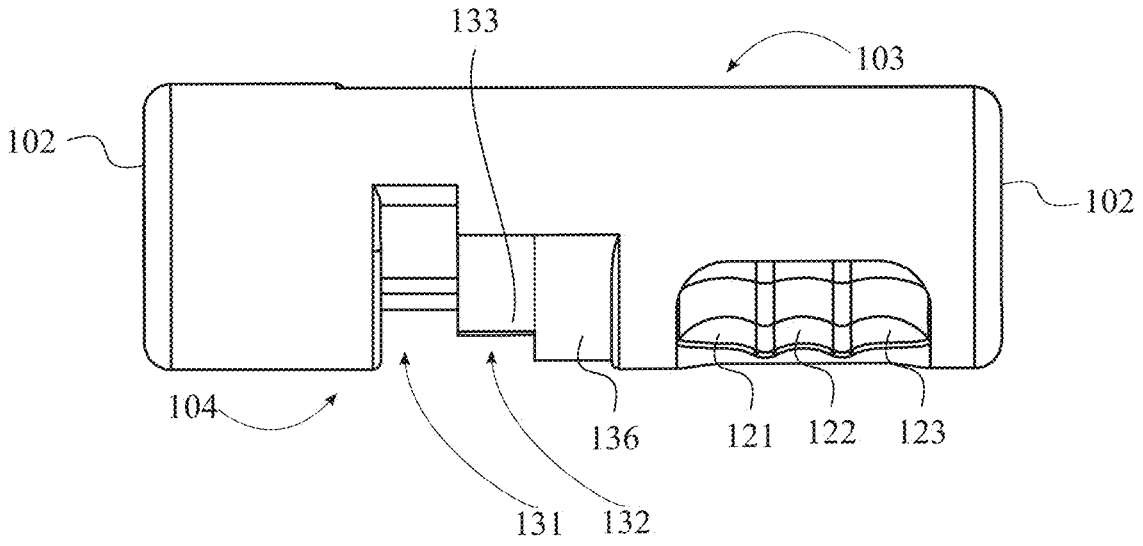
FIG. 4 depicts another perspective view of the cam selector of the present invention.
Figure 5:
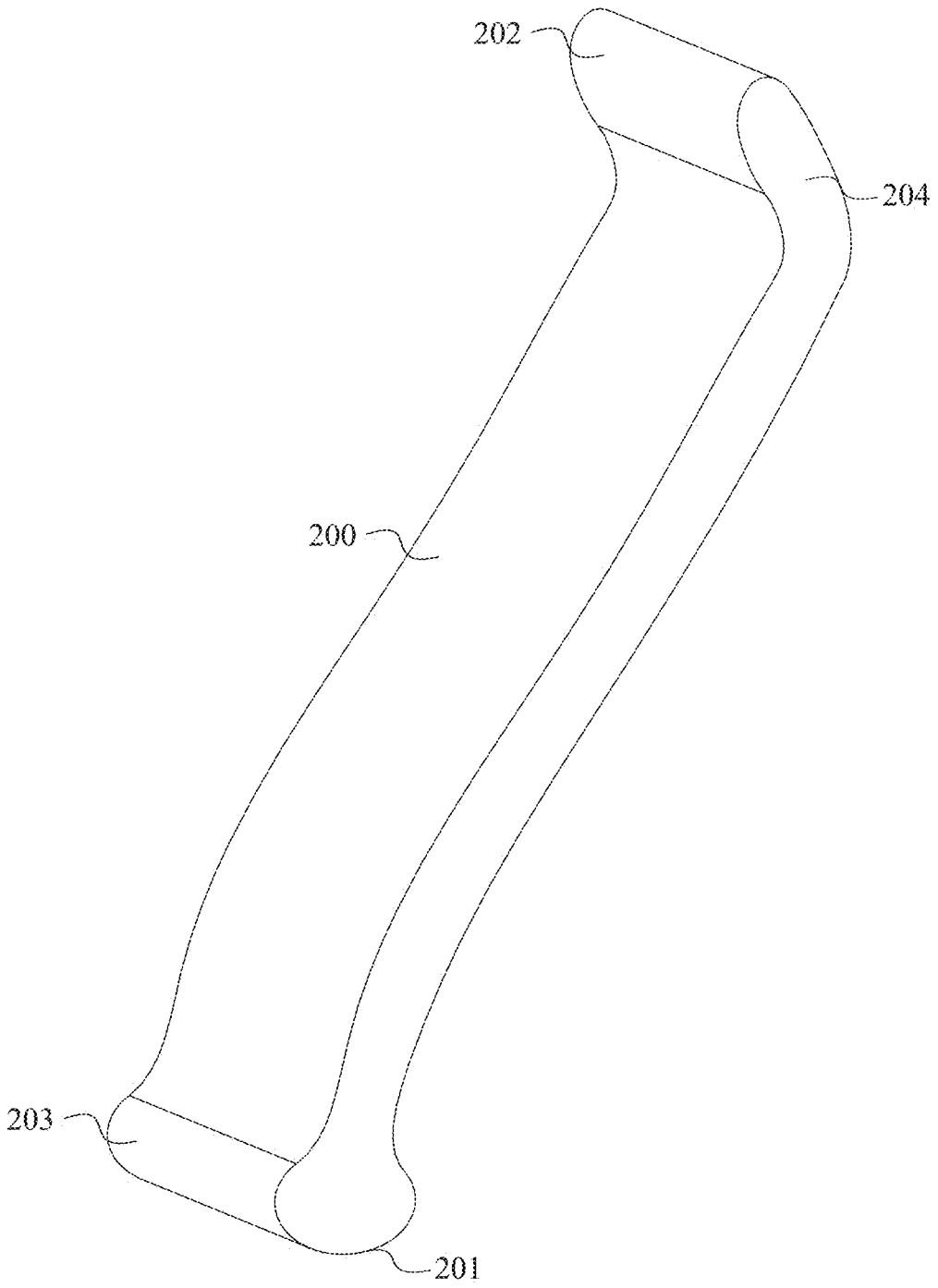
FIG. 5 depicts a perspective view of a lever of the present invention.
Figure 6:
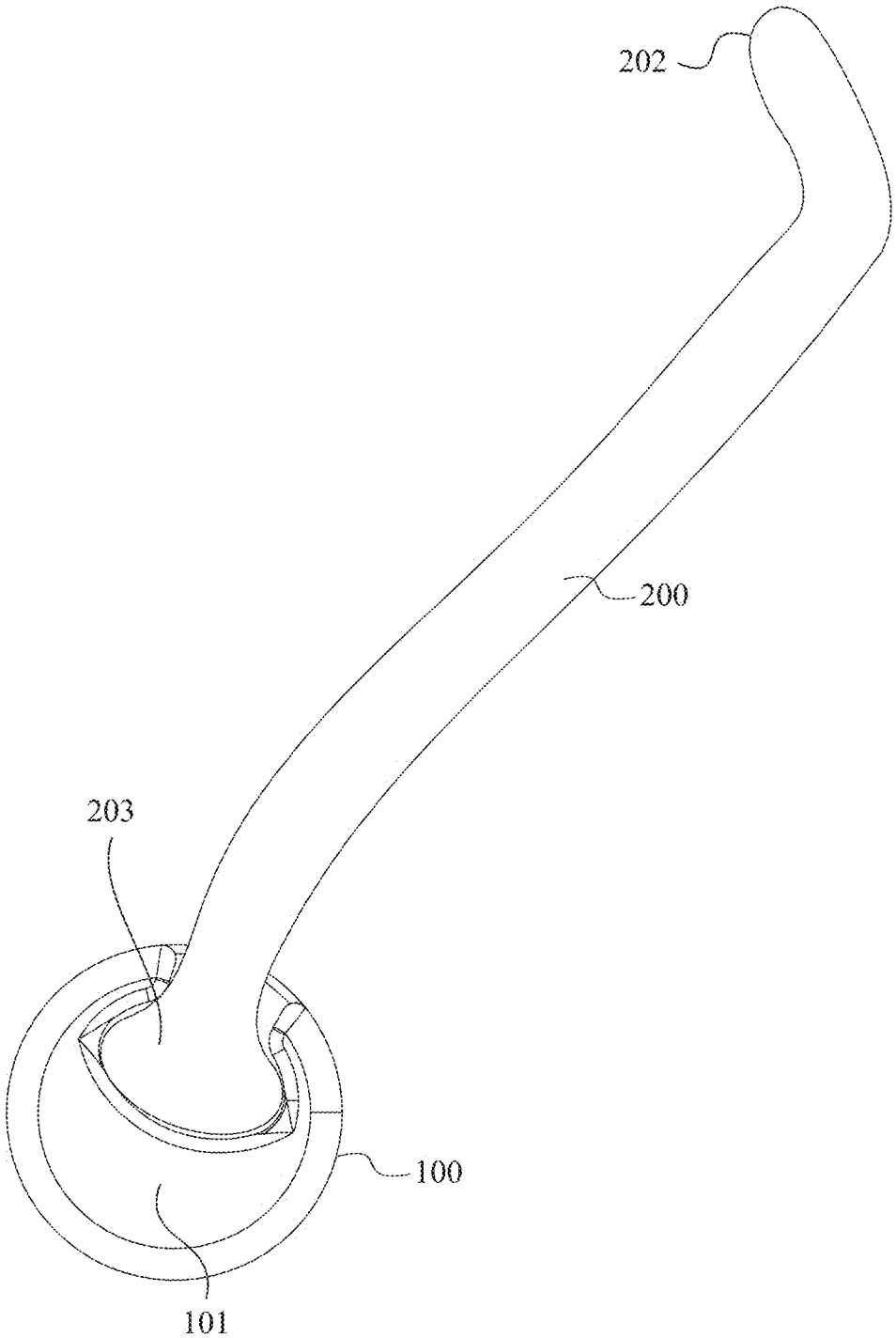
FIG. 6 depicts a left-side view of the cam and lever assembled together.
Figure 7:
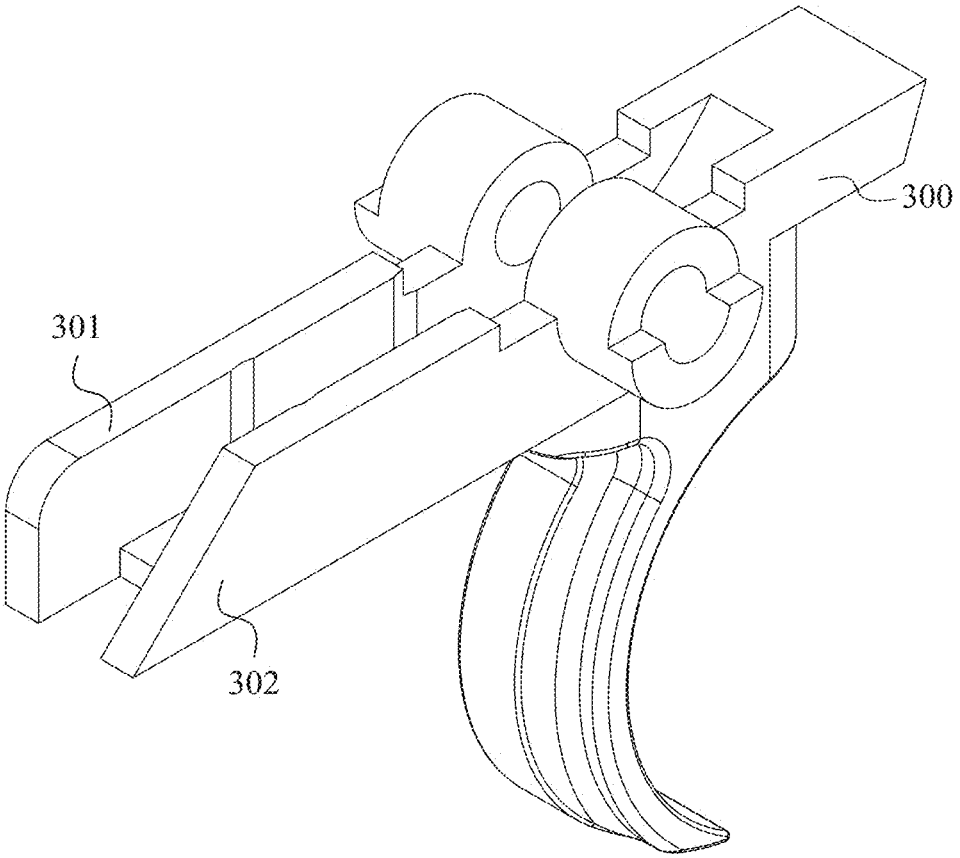
FIG. 7 depicts a perspective view of a trigger of the present invention.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure and is made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim a limitation found herein that does not explicitly appear in the claim itself. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. When not explicitly defined herein, to the extent that the meaning of a term used herein—as understood by the ordinary artisan based on the contextual use of such term—differs in any way from any particular dictionary definition of such term, it is intended that the meaning of the term as understood by the ordinary artisan should prevail.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims. The present disclosure contains headers. It should be understood that these headers are used as references and are not to be construed as limiting upon the subject matter disclosed under the header.

Other technical advantages may become readily apparent to one of ordinary skill in the art after review of the following figures and description. It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Unless otherwise indicated, the drawings are intended to be read together with the specification and are to be considered a portion of the entire written description of this invention. As used in the following description, the terms "horizontal", "vertical", "left", "right", "up", "down" and the like, as well as adjectival and adverbial derivatives thereof (e.g., "horizontally", "rightwardly", "upwardly", "radially", etc.), simply refer to the orientation of the illustrated structure as the particular drawing figure faces the reader. Similarly, the terms "inwardly," "outwardly" and "radially" generally refer to the orientation of a surface relative to its axis of elongation, or axis of rotation, as appropriate. As used herein, the term "proximate" refers to positions that are situated close/near in relationship to a structure. As used in the following description, the term "distal" refers to positions that are situated away from positions.

The present disclosure includes many aspects and features. Moreover, while many aspects and features relate to, and are described in the context of safety mechanisms for a firearm, embodiments of the present disclosure are not limited to use only in this context.

The present invention is a safety mechanism for a firearm, in particular an AR-15. It is an aim of the present invention to turn a standard AR-15 into a three-position fire control unit (i.e., semi-automatic, active reset and safe positions). It is another aim of the present invention to provide a safety mechanism that can rotate within the firearm to engage various firing modes.

Referring now to the figures of the present disclosure. The safety mechanism of the present invention comprises a cam selector 100, a lever 200, and a trigger 300.

The cam selector 100 of the present invention is designed to replace a standard safety selector in the firearm. It should be noted that the cam selector 100 can be of any shape, size, material, features, type or kind, orientation, location, quantity, components, and arrangements of components that would allow the present invention to fulfill the objectives and intents of the present invention. In one embodiment, the cam selector 100 comprises a first end 101, a second end 102, a top side 103, and a bottom side 104. Preferably, the cam selector 100 has a substantially cylindrical shape. It should be noted that the cam selector 100 may be made of any suitable material but is preferably made of stainless steel. The cam selector 100 comprises a longitudinal slot 110 positioned on the top side of the cam selector 100. The longitudinal slot 110 is configured to receive a proximal end 201 of the lever 200. In one embodiment, the longitudinal slot 110 extends from the first end 101 of the cam selector 100. Preferably, the longitudinal slot 110 is ovular shaped and comprises an opening 112 to allow the lever 200 to travel through. The lever 200, which will be described in more detail hereinafter, will interact with other components of the firearm, such as the hammer or the bolt carrier, to rotate about the proximal end 201 reciprocally within a certain angular range (e.g., 8-12 degrees), thereby creating a torque force on the cam selector 100 to rotate the cam selector 100 forward or backward.

The cam selector 100 comprises a first recess 131 and a second recess 132 on the bottom side 104 of the cam selector 100. The first recess 131 and a second recess 132 are transverse recesses on the cam selector 100, perpendicular to the rotation axis of the cam selector 100. A length of the first recess 131 is greater than a length of the second recess 132. Preferably, the length of the first recess 131 is twice the length of the second recess 132. The first recess 131 and the second recess 132 abut each other, forming an overall "L" shaped cutout. Due to the shorter length of the second recess 132, a cam portion 133 is formed by the second recess 132. The trigger 300 is similar to a standard trigger in the firearm (e.g., an AR-15) but features a modified trigger tail designed to interact with the cam selector 100 of the present invention. Specifically, the trigger 300 comprises a first trigger tail portion 301. The first trigger tail portion 301 will interact with the first recess 131, the second recess 132, and a safety cam profile 136 of the cam selector 100, respectively in different firing modes. Preferably, the first trigger tail portion 301 of the trigger 300 is rounded to facilitate the operation of the present invention. In another embodiment, the trigger 300 further comprises a second trigger tail portion 302 that has a corner cutout such that the second trigger tail portion 302 will not interfere with the operation of the trigger 300 and/or the cam selector 100.

The cam selector 100 is configured to operate between a first mode, a second mode, and a third mode, corresponding to the semi-automatic position, the active reset, and the safe position of the cam selector 100, respectively. The first mode of the cam selector 100 is configured to allow the first trigger tail portion 301 to be movable within the first recess 131. In this mode, the cam selector 100 will not interfere with the trigger 300, allowing the firearm to operate in the standard semi-automatic mode. The second mode of the cam selector 100 is configured to allow the first trigger tail portion 301 to engage the second recess and be moved down by a cam portion 133 of the second recess 132 when the cam selector rotates. The second mode resets the pressure and forces the trigger 300 to reset. The third mode of the cam selector 100 is configured to prevent the trigger 300 from being pulled. Specifically, the safety cam profile 136 of the cam selector 100 restricts any rotation of the trigger 300, preventing it from being pulled regardless of the direction in which the dual cam is rotated.

Figure 8:
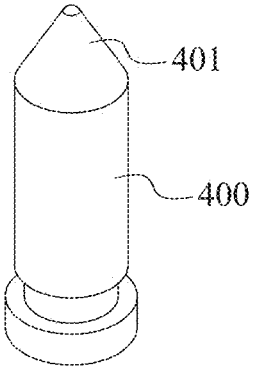
FIG. 8 depicts a perspective view of a detent of the present invention.
Figure 9:
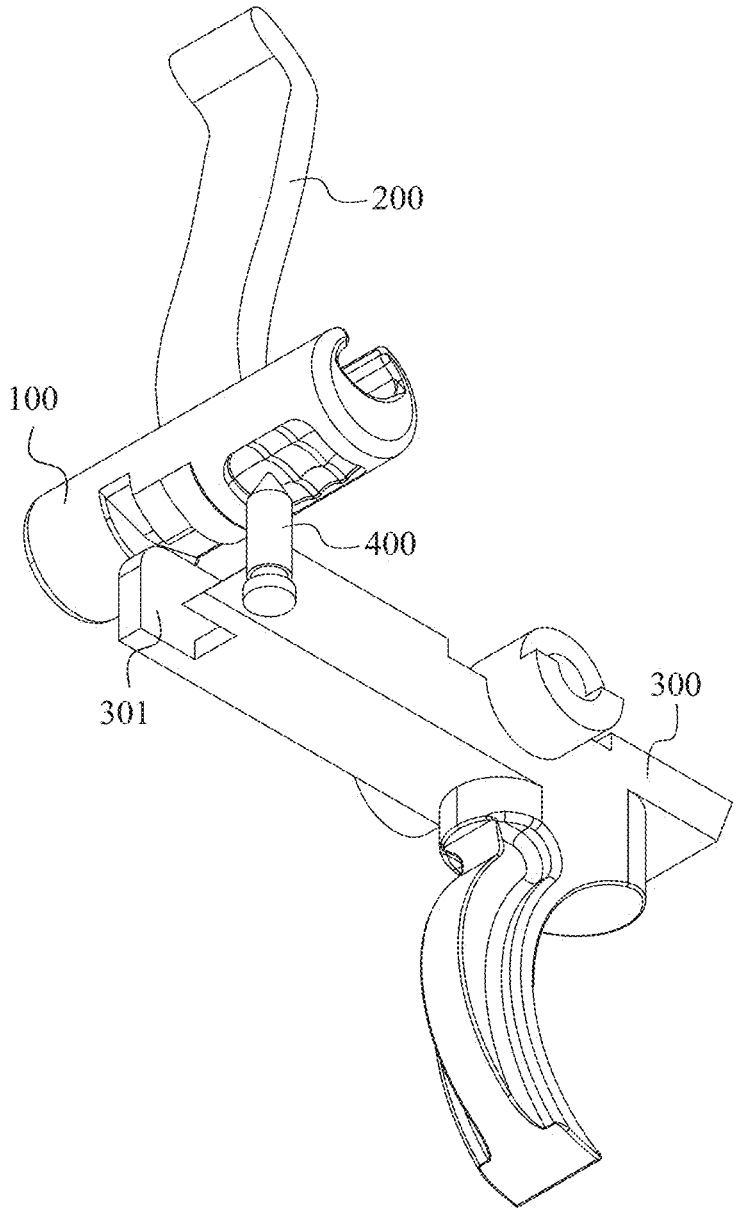
FIG. 9 depicts a perspective view of the present invention in its semi-automatic position.
Figure 10:
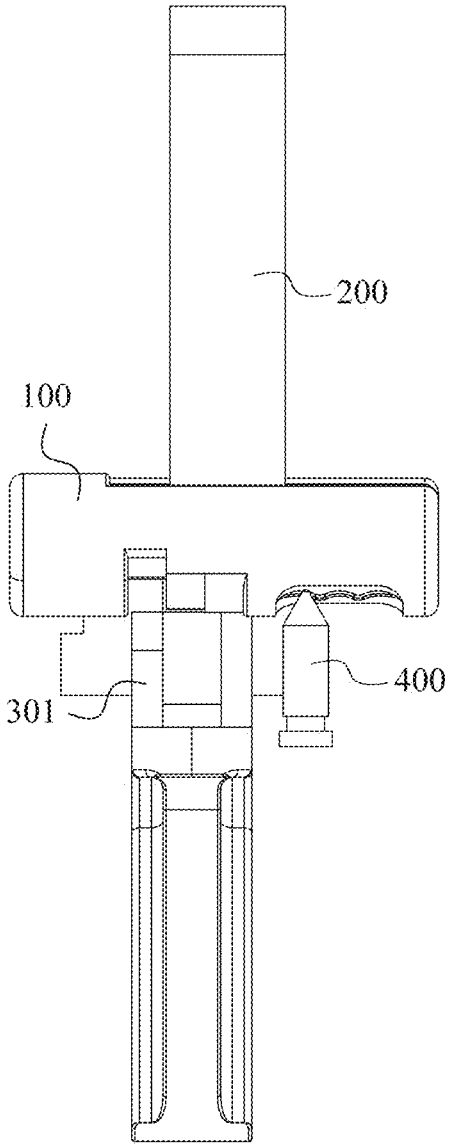
FIG. 10 depicts a rear view of the present invention in its semi-automatic position.
Figure 11:
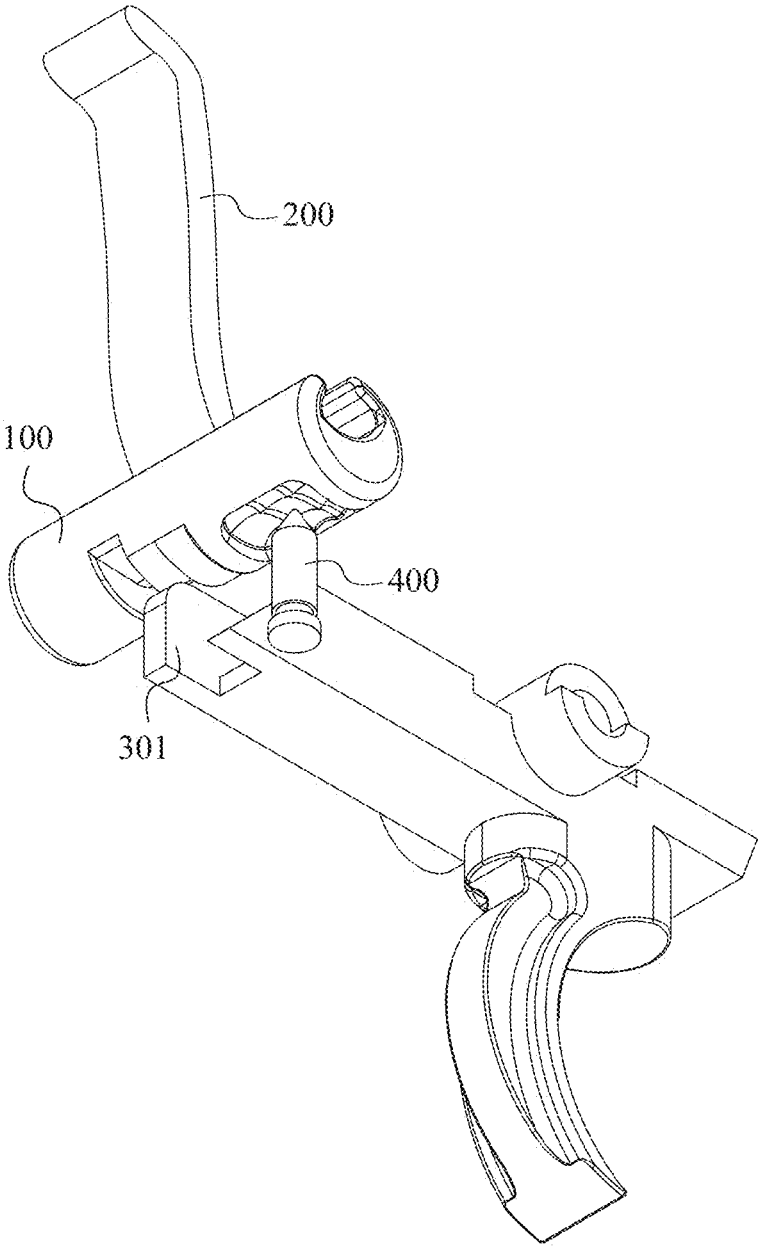
FIG. 11 depicts a perspective view of the present invention in its active reset position.
Figure 12:
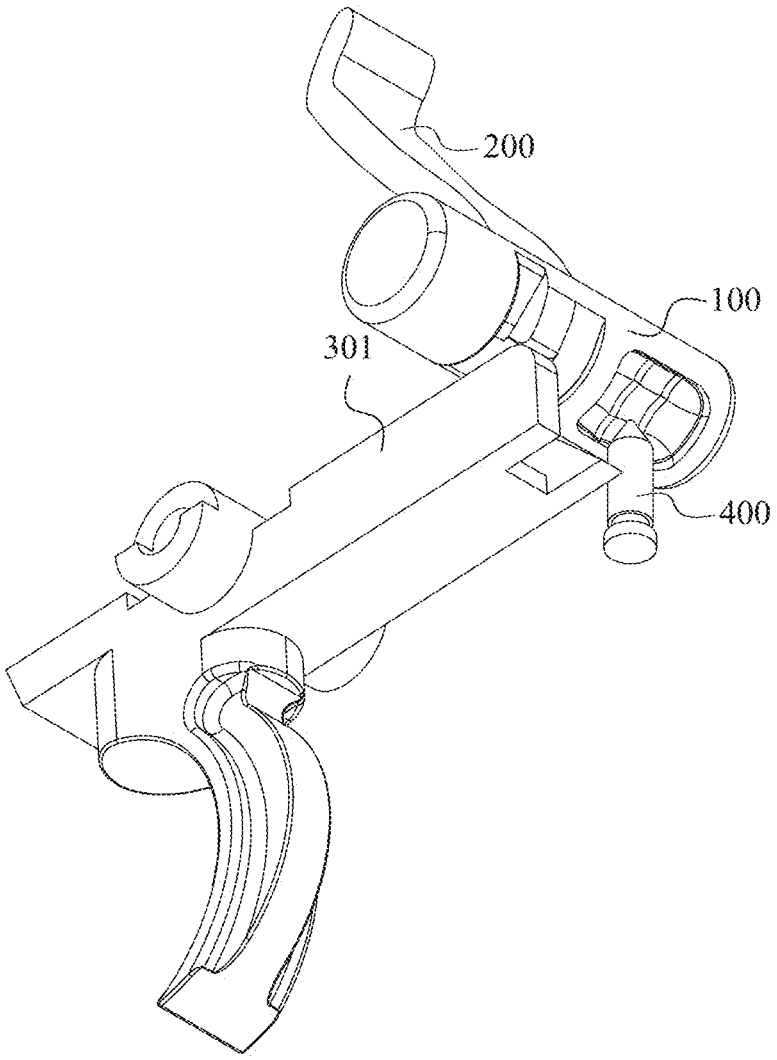
FIG. 12 depicts a perspective view of the present invention in its active reset position, wherein the trigger is pulled.
Figure 13:
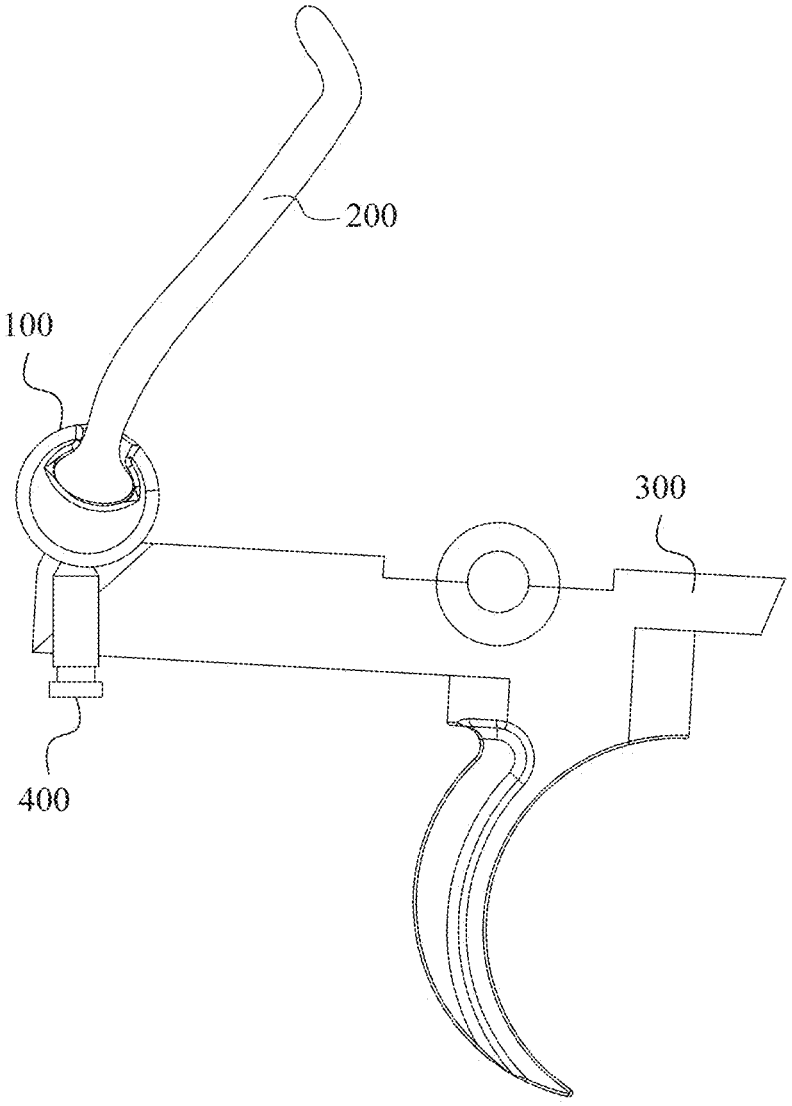
FIG. 13 depicts a side view of the present invention in its active reset position, wherein the trigger is pulled.
Figure 14:
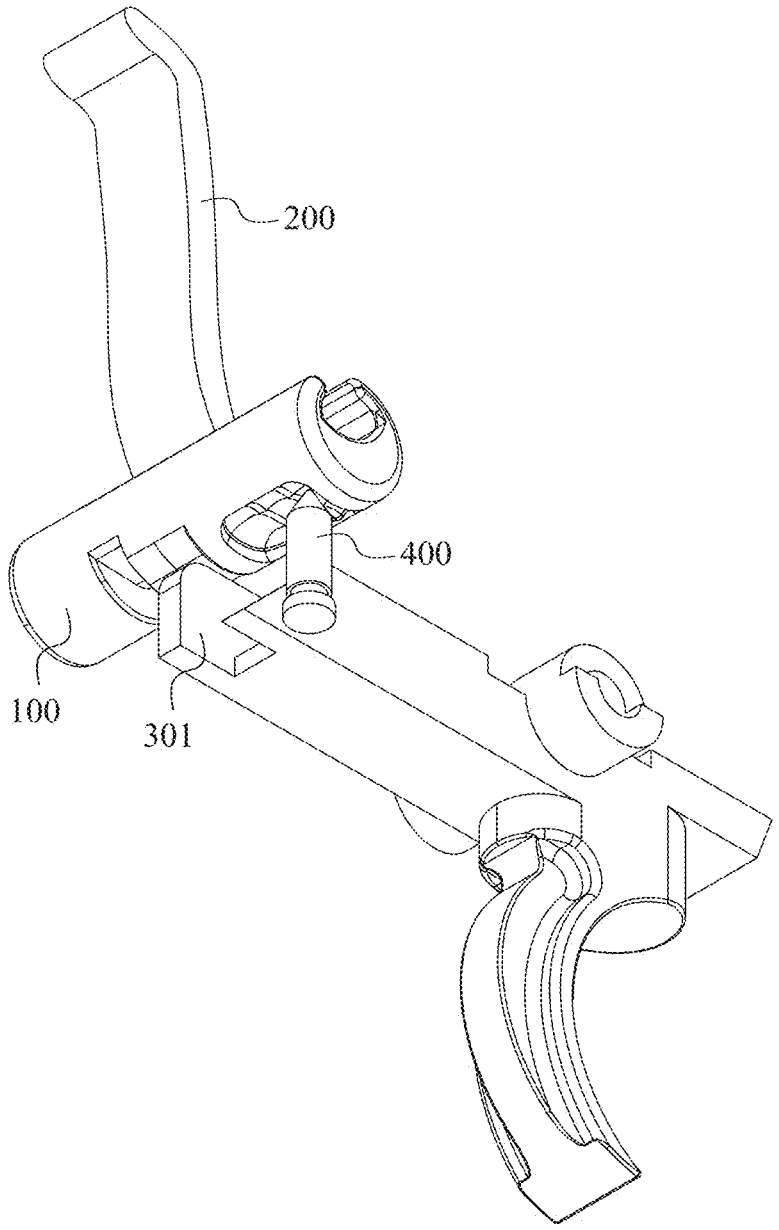
FIG. 14 depicts a perspective view of the present invention in its safe position.
Figure 15:
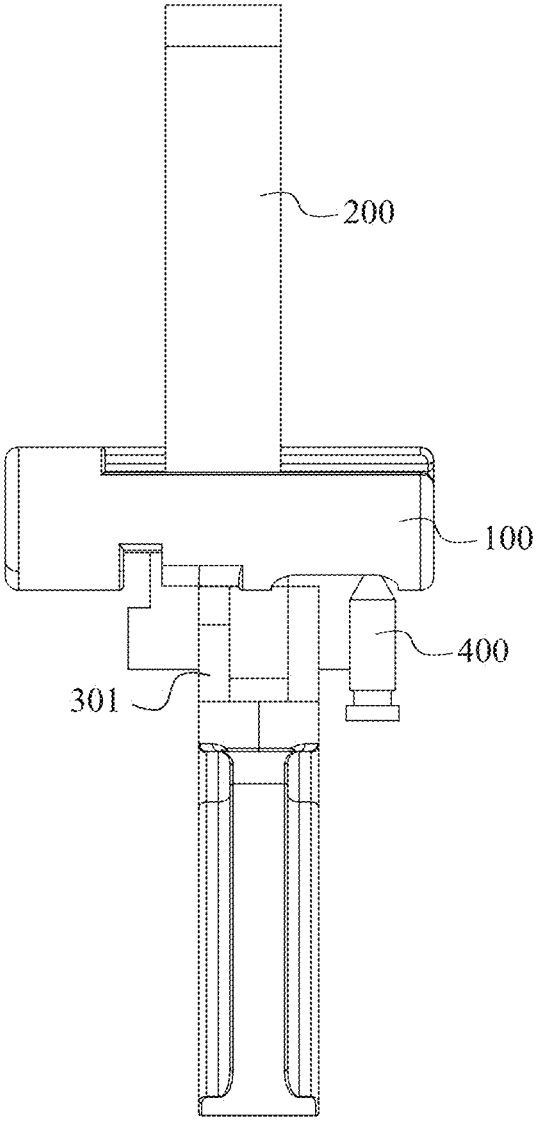
FIG. 15 depicts a rear view of the present invention in its safe position.

In a preferred embodiment, the present invention employs a unique detent-track mechanism to switch between different firing modes. The present invention may comprise a detent 400, and the cam selector 100 further comprises a first detent track 121, a second detent track 122, and a third detent track 123. The detent 400 is configured to move between the first detent track 121, the second detent track 122, and the third detent track 123 to select between the first mode, the second mode, and the third mode of the cam selector 100. The detent 400 may be a pin-like member, as shown in FIG. 8. In a preferred embodiment, the detent 400 may have a rounded top end 401 to facilitate smooth transitions between the different firing modes. The top end 401 slides against the first detent track 121, the second detent track 122, or the third detent track 123 in different firing modes. The detent 400 may be contained in a passage within the lower receiver of the firearm and biased against the cam selector 100 by a spring. This design allows the user to switch between firing modes by simply pushing the cam selector 100 to the right or left, while effectively preventing unintended lateral movement of the cam selector 100. In a preferred embodiment, the first detent track 121, the second detent track 122, and the third detent track 123 are configured to allow the detent to move along the first detent track 121, the second detent track 122, and the third detent track 123, respectively. In this way, the detent 400 allows the cam selector 100 to rotate within a certain range. Preferably, the first detent track 121, the second detent track 122, and the third detent track 123 are transverse grooves on the bottom side 101 of the cam selector 100. In one embodiment, the first detent track 121, the second detent track 122, and the third detent track 123 may be formed by a plurality of ridges and grooves. In another embodiment, the first detent track 121, the second detent track 122, and the third detent track 123 are positioned adjacent to the first end of the cam selector. The detent 400 and the plurality of detent tracks serve dual purposes: restricting the cam selector's rotation to its intended range of motion and selecting different cam selector profiles to engage with the trigger 300.

The lever 200 is configured to transfer torque onto the cam selector 100 and thus rotate the cam selector 100. It should be noted that the lever 200 can be of any shape, size, material, features, type or kind, orientation, location, quantity, components, and arrangements of components that would allow the present invention to fulfill the objectives and intents of the present invention. In one embodiment, the lever 200 comprises a proximal end 201 and a distal end 202. Preferably, the lever comprises a dovetail portion 203 at the proximal end 201. In one embodiment, the lever 200 further comprises a bent portion 204 adjacent to the distal end 202. It should be noted that the opening 112 of the longitudinal slot 110 is wider than the lever 200, allowing a void or clearance to be formed between the lever 200 and the edge of the opening 112. The void can be on either side of the lever 200, depending on which direction the lever is pivoting. In other words, when the lever 200 pivots, it does not immediately transfer torque onto the cam selector 100 until the void is filled.

The present invention is designed to replace the standard safety within the receiver of a firearm such as an AR-15. The present invention engages with external components within a standard firearm as explained below. In its preferred embodiment, the trigger 300 and disconnector are pivotally mounted to the lower receiver by a transverse pin and pushed forward by a spring. The hammer is pivotally mounted to the lower receiver by a transverse pin and is pushed forward and can be rotated by a spring.

As mentioned above, the detent 400 is contained in a passage within the lower receiver and is pushed up against the cam by a spring. The bolt carrier reciprocates within the upper receiver. In the second mode of the present invention (i.e., the active reset mode), when the hammer is cocked and the trigger is in its forward position, the firearm is ready to fire. When the trigger bow is pulled to the rear by the operator, the trigger sear releases the hammer sear, allowing the hammer to swing forward under spring pressure. The striking surface of the hammer strikes the firing pin, thereby firing the firearm. As the trigger bow is pulled, the first trigger tail portion 301 of the trigger 300 moves up into the second recess 132 of the cam selector 100.

The first trigger tail portion 301 of the trigger 300 slides against the cam portion 132, rotating the cam selector 110 forward until the upper surface of the trigger is resting in the relief area of the modified trigger. The disconnector is rotated forward about its pivot congruent with the motion of the trigger. This allows the fire control group and mechanism to be in the fired state. This is when the hammer falls, and the trigger bow is pulled. As the bolt carrier moves to the rear under gas pressure, the hammer cam point pivotally displaces the hammer back down into the former ready state. The tail of the hammer may push the lever 200 out of its path as it swings back. The hammer hook on the hammer snaps past and may engage with the disconnector hook. The hammer is held down by the hammer cam surface as the bolt carrier continues to move toward the back of the firearm.

As the bolt carrier continues to move, the hammer cam presses against the distal end 202 of the lever 200, rotating the lever 200 toward the back. As the lever 200 rotates, it transfers torque to the cam selector 100 via the dovetail portion 203. As the cam selector 100 rotates, the cam portion 133 slides against the first trigger tail portion 301 of the trigger 300, moving the tail of the trigger down, and rotating the trigger back into the former ready position. The trigger sear then engages the hammer sear. The disconnector pivots back rearward about its pivot congruent with the motion of the trigger 300. The hammer hook on the hammer may no longer engage with the disconnector hook.

When the bolt carrier is in its most rearward position, the lever 200 is held to the rear by the hammer cam surface and the cam selector is rotated so that the cam selector is against the top surface of the trigger tail. The trigger is held in the reset position by the cam selector 100 and cannot be pulled by the operator as the cam selector 100 is blocking the trigger's tail from moving up. As the bolt carrier moves forward again under spring pressure, the hammer is released by the hammer cam surface and the hammer sear engages the trigger sear, preventing the hammer from falling. As the bolt carrier moves forward, the rear surface of the bolt carrier presses against the second end 202 of the lever 200, rotating the lever 200 forward. It should be noted that the lever 200 does not immediately transfer torque onto the cam selector 100. The lever 200 pivots in the cam selector 100 until the void is filled. Once the void is filled, the lever 200 can transfer torque to the cam selector 100.

The amount that the lever 200 rotates in the longitudinal slot 110 before transferring torque to the cam selector 100 is such that as the bolt carrier completes its forward movement, the cam selector 100 rotates to a position where the first trigger tail portion 301 begins to slide against the cam portion 133. Once the cam selector 100 moves into this position, the trigger bow can be pulled again by the operator as previously described.

If the left side of the cam selector 100 is pressed by the operator, the cam selector 100 will transversely shift to the right and be held in the right position by the detent track and detent. In this example, when the cam selector 100 is resting to the right, the first recess 131 of the cam selector 100 can engage with the first trigger tail portion 301, and the present invention will operate in the semi-automatic mode, as described previously. If the right side of the cam selector 100 is pressed by the operator, the cam selector 100 will transversely shift to the left and be held in this position by the detent track and the detent. In this example, when the cam selector 100 is resting to the left, the safety cam profile 136 engages with the trigger tail and prevents the trigger from being pulled regardless of what position the cam is rotated to. In other words, by pressing the right side or the left side, the manual safety can be engaged or disengaged. When the cam selector 100 is transversely shifted to the right or left, the lever is held approximately in the center of the firearm by the walls of the receiver of the firearm. The cam selector 100 can move transversely in the firearm independent of the lever 200, as the dovetail portion 203 on the lever can move transversely within the longitudinal slot 110 on the cam selector 100.

In one embodiment, the cam selector 100 can be expanded to support more cam profiles. Additional detent tracks may be provided to support another position, and another cam profile would be added to the cam selector 100 alongside, or in between the current profiles. An example of this would be to add another profile similar to the safety profile, but of a smaller diameter. If this profile was selected by transversely sliding the cam selector 100 to the proper position, it would be of a small enough diameter not to engage the first trigger tail portion regardless of what position the cam selector 100 was rotated to. This would result in the fire control group functioning as before, but without the cam selector 100 actively resetting the trigger. This would allow the operator to fire precise single shots more effectively due to the geometric constraints of the AR-15. With all the components working in tandem with each other, it can be seen that the present invention is a safety mechanism that provides the firearm user with a three-position fire control unit.

Although the disclosure has been explained in relation to its preferred embodiment, it is to be understood that many other possible modifications and variations can be made without departing from the spirit and scope of the disclosure.

What is claimed is:

1. A safety mechanism for a firearm comprising:
a cam selector;
a lever;
a trigger;
the cam selector comprising a first end, a second end, a top side, and a bottom side;
the cam selector comprising a longitudinal slot positioned on the top side of the cam selector;
the lever comprising a proximal end and a distal end;
the longitudinal slot being configured to receive the proximal end of the lever;
the cam selector further comprising a first recess and a second recess on the bottom side of the cam selector;
the trigger comprising a first trigger tail portion;
the cam selector being configured to operate between a first mode, a second mode, and a third mode;
wherein the first mode of the cam selector is configured to allow the first trigger tail portion to be movable within the first recess, wherein the second mode of the cam selector is configured to allow the first trigger tail portion to engage the second recess and be moved down by a cam portion of the second recess when the cam selector rotates, and wherein the third mode of the cam selector is configured to prevent the trigger from being pulled.

2. The safety mechanism as claimed in claim 1, wherein the cam selector has a substantially cylindrical shape.

3. The safety mechanism as claimed in claim 1, further comprising:
a detent;
the cam selector further comprising a first detent track, a second detent track and a third detent track;
the detent being configured to move between the first detent track, the second detent track and the third detent track to select between the first mode, the second mode, and the third mode of the cam selector.

4. The safety mechanism as claimed in claim 3, wherein the first detent track, the second detent track, and the third detent track are configured to allow the detent to move along the first detent track, the second detent track, and the third detent track, respectively.

5. The safety mechanism as claimed in claim 4, wherein the first detent track, the second detent track, and the third detent track are transverse grooves on the bottom side of the cam selector.

6. The safety mechanism as claimed in claim 5, wherein the first detent track, the second detent track and the third detent track are positioned adjacent to the first end of the cam selector.

7. The safety mechanism as claimed in claim 3, wherein the detent comprises a rounded top end.

8. The safety mechanism as claimed in claim 1, wherein the longitudinal slot extends from the first end of the cam selector.

9. The safety mechanism as claimed in claim 8, wherein the longitudinal slot is ovular shaped and comprises an opening to allow the lever to travel trough.

10. The safety mechanism as claimed in claim 9, wherein the lever comprises a dovetail portion at the proximal end.

11. The safety mechanism as claimed in claim 10, wherein the lever further comprises a bent portion adjacent to the distal end.

12. The safety mechanism as claimed in claim 1, wherein the first trigger tail portion of the trigger is rounded.

13. The safety mechanism as claimed in claim 12, wherein the trigger further comprises a second trigger tail portion that has a corner cutout.

* * * * *